US005199703A

United States Patent [19]

Hess

[11] Patent Number: 5,199,703

[45] Date of Patent: Apr. 6, 1993

[54] DEVICE FOR STACKING AND ALIGNING INDIVIDUALLY SUPPLIED SHEETS

[75] Inventor: Werner Hess, Stuttgart, Fed. Rep. of Germany

[73] Assignee: Eastman Kodak Company, Rochester, N.Y.

[21] Appl. No.: 799,226

[22] Filed: Nov. 27, 1991

[30] Foreign Application Priority Data

Jan. 18, 1991 [DE] Fed. Rep. of Germany ..... 4101381

[51] Int. Cl.[5] ..... B65H 29/20; B65H 31/26; B65H 9/16

[52] U.S. Cl. ..... 271/314; 271/220; 271/236; 271/250

[58] Field of Search ..... 271/236, 250, 220, 184, 271/314

[56] References Cited

U.S. PATENT DOCUMENTS

| | | | |
|---|---|---|---|
| 4,379,549 | 4/1983 | Mizuma | 271/236 X |
| 4,657,240 | 4/1987 | Bolliger | 271/250 |
| 4,718,657 | 1/1988 | Otter et al. | 271/285 |
| 4,799,084 | 1/1989 | Koike et al. | 271/250 X |
| 4,805,892 | 2/1989 | Calhoun | 271/250 X |
| 5,120,047 | 6/1992 | Mandel et al. | 271/236 X |

FOREIGN PATENT DOCUMENTS

| | | | |
|---|---|---|---|
| 3107768 | 2/1981 | Fed. Rep. of Germany . | |
| 123834 | 9/1980 | Japan | 271/184 |

*Primary Examiner*—Robert P. Olszewski
*Assistant Examiner*—Boris Milef
*Attorney, Agent, or Firm*—Lawrence P. Kessler

[57] ABSTRACT

At the free end of an arm (1) which is pivotable about a shaft (12), a driven coupling portion (3) with a claw coupling (3*a*) is rotatably mounted, such coupling being held in positive engagement with a sleeve (5) shiftable on a shaft (2). Sleeve (5) is provided with a circumferential cam groove (5*b*) which has an advancing and returning pitch and is engaged by a stationary projection (11). Sleeve (5) is provided with a concentrical collar (5*d*) on which a second wheel (4), having a smooth circumferential surface, is shiftably mounted and held in positive engagement. On an eccentric collar (5*a*) of sleeve (5), a first wheel (6) designed as a radial ball bearing is mounted whose circumferential surface has high static friction. When sleeve (5) is set in motion, it moves to and fro, the second wheel (4) being urged via an inclined surface (4*b*, 4*c*) into contact with the first wheel (6) and entraining said wheel by frictional engagement. The cam groove (5*b*) and the eccentric mounting of the first wheel (6) are adapted to each other such that the first wheel (6) is driven in a pulse-type manner by frictional engagement and acts in a pulse-type manner on the sheet to be aligned.

10 Claims, 4 Drawing Sheets

DEVICE FOR STACKING AND ALIGNING INDIVIDUALLY SUPPLIED SHEETS

BACKGROUND OF THE INVENTION

The invention relates, in general, to a device for aligning sheets which are individually supplied to a collecting tray in which they are stacked one above the other and, in particular, to a sheet-aligning device for use with a collecting tray which comprises a support surface and a lateral limiting wall arranged parallely with the direction of entrance of the sheets as well as an abutment associated with the front end side of the sheets, such device including a drivable wheel which is arranged at the free end of a pivotable arm and rests on the incoming sheet and which aligns such sheet both at the lateral limiting wall and at the front abutment.

It is known (see, for example DE-31 07 768, C2) for individually supplied sheets to be aligned with respect to a front abutment and a lateral limiting wall of a collecting tray by a roller positioned obliquely to the direction of sheet transport. It is also known (see, for example U.S. Pat. No. 4,718,657) for the surface of the sheet stack to be sensed and kept at a predetermined level by means of a rotatable and pivotable aligning roller which serves to stack the sheets in a staggered arrangement. In both of these known devices, the aligning roller constantly subjects the uppermost sheet to the same pressure force, whereby, in particular, thin sheets of only slight inherent stiffness may become compressed so that the plane position of the sheets deposited cannot be ensured. If sheets collected in stacks are to be further processed, for example stapled in sets, the sheets must be sufficiently plane to allow them to be properly stapled.

SUMMARY OF THE INVENTION

This invention is directed to an aligning device wherein the incoming sheets can be stacked rapidly and reliably and free from tension, and wherein the sheet stack is maintained at a level which allows the collected sheets to be further processed. According to this invention, the aligning device comprises two drivable wheels of identical diameter which are arranged on a common shaft provided on the free end of an arm. The first wheel is eccentrically mounted on the shaft, and the second wheel concentrically mounted on the shaft. The first wheel is mounted for rotation on a collar of a rotatably mounted sleeve, such collar being arranged eccentrically with respect to the shaft. The second wheel is arranged on a collar of the rotary sleeve, such collar being arranged concentrically with respect to the shaft. The sleeve, together with the first and the second wheel, are shiftable on the shaft with the second wheel held in positive engagement with the sleeve. The sleeve is held in permanent positive engagement with a rotatably mounted and drivable coupling portion, and the first wheel, when resting on the incoming sheet, can be shifted toward the lateral limiting wall and, when lifted from said sheet, in the opposite direction.

Further, according to the invention, the aligning device comprises two wheels of identical diameter which are arranged on a common shaft provided on the free end of an arm, of which the first wheel is eccentrically mounted on the shaft and the second wheel is concentrically mounted on the shaft. The first wheel is rotatably mounted by frictional engagement on a collar of a rotatably mounted sleeve, the collar being arranged eccentrically with respect to the shaft, and the second wheel is shiftable on a collar of the rotatable sleeve, the collar being arranged concentrically with respect to the shaft. The sleeve, together with the first and second wheel, is shiftable on the shaft, the second wheel being held in positive engagement with the sleeve. The sleeve is permanently held in positive engagement with a rotatably mounted and drivable coupling portion. The first wheel, when resting on the incoming sheet, is shiftable toward the lateral limiting wall and, when lifted from such sheet, is shiftable in the opposite direction, and a switch is arranged in the path of pivotal movement of the arm, such switch interrupting the further transport of sheets to the collecting tray after a predetermined height of the sheet stack has been reached.

According to an advantageous modification of the sheet-aligning device of this invention, the circumferential surface of the sleeve is provided with a circumferential cam groove held in engagement with a stationary projection and having in its shifting direction an advancing and returning pitch so that the sleeve, when made to rotate, carries out a reciprocating movement, together with the first and second wheel. The sheet-aligning device, according to the modification, advantageously allows incoming sheet to be transported and aligned by a pulse-type temporary engagement so that tension built up by compression can be relieved in the nontransport intervals, and the sheet can be stacked in a plane position. In a particularly advantageous manner, the pulse-type engagement of the sheets is brought about by a wheel supported on a ball bearing, which is periodically driven such that it is entrained by frictional engagement in its lifted position. When placed on the incoming sheet, however, it transport such sheet solely by its own momentum. The advantage is that the sheet is only engaged and aligned by the entraining momentum of the wheel thus caused so that it is not unnecessarily compressed when it reaches its aligned position.

The invention, and its objects and advantages, will become more apparent in the detailed description of the preferred embodiment presented below.

BRIEF DESCRIPTION OF THE DRAWINGS

Further features and advantages can be inferred from the description of embodiments of the invention illustrated in the drawings and from the subclaims. The drawings show:

DESCRIPTION OF THE PREFERRED EMBODIMENTS

Figure 1:
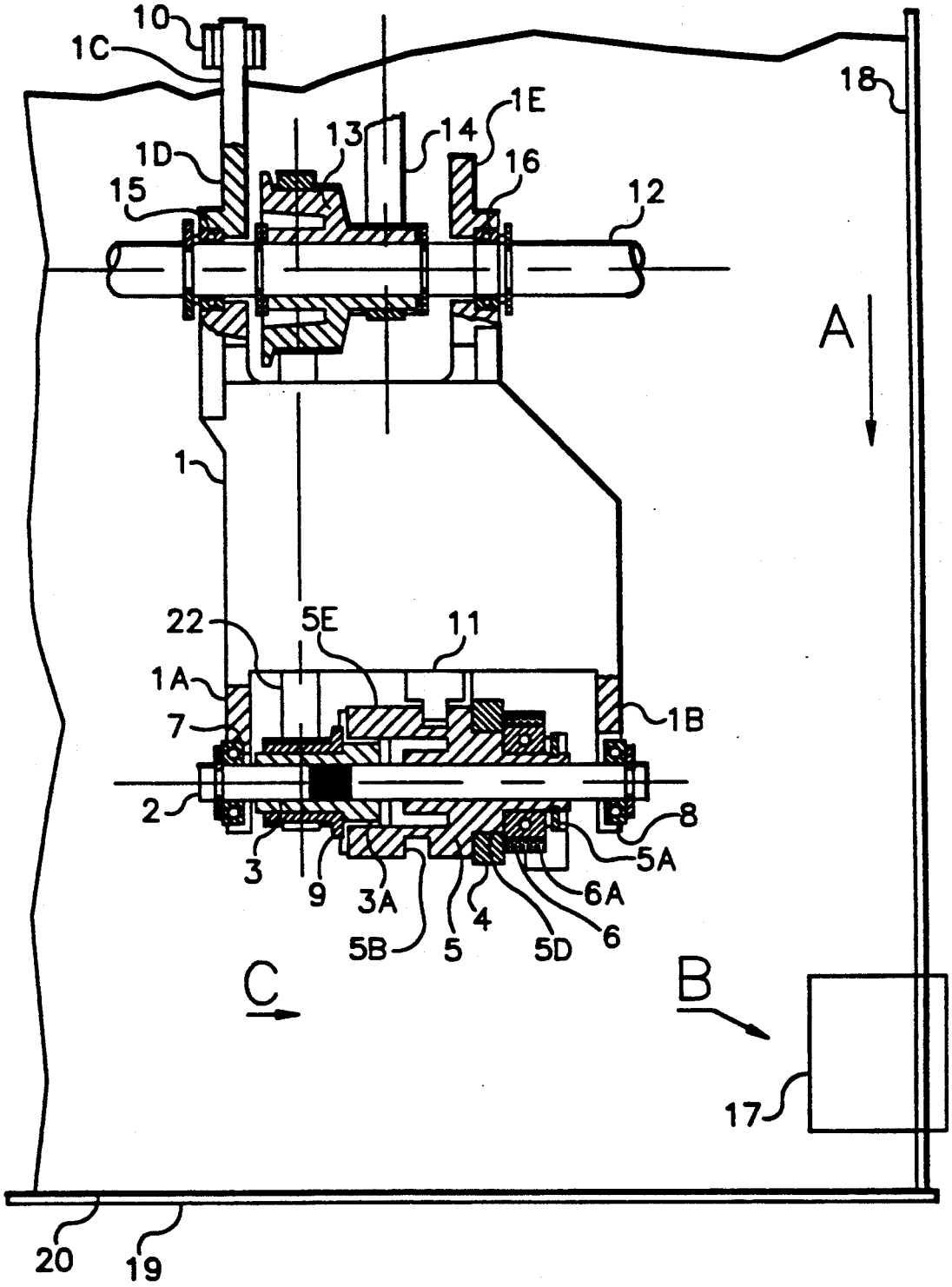
FIG. 1 is a partially sectional plan view of the sheet-aligning device according to this invention.

The device for aligning sheets according to the invention is arranged in a finisher unit of a known type (not illustrated) in which individually supplied sheets, in particular sheet produced by a copier, are combined in sets in a collecting tray 20 and stapled using a stapling device 17. Of the finisher unit, which is connected with a copier (not illustrated), only those part are shown as are necessary to understand the invention.

Sheets are supplied in the direction of the arrow "A" to a collecting tray 20 which is inclined in the direction of movement of the sheet and in which the sheets are deposited on a sheet stack 21. During the supply operation, the individual sheets are moved into the range of action of an aligning device, to be described further below, which places the sheets into contact with a front abutment 19 and a lateral limiting wall 18. The sheets are aligned in the range of action of a stapling device 17 of a type known per se and not illustrated whose position is indicated in dash-dotted lines.

Above the collecting tray 20, an arm 1 is pivotally mounted about a shaft 12 by means of ball bearings 15, 16. The ball bearings 15, 16 are positively and frictionally held on U-shaped webs **1*d*, 1*e* of arm 1 by snap connections. Between the webs 1*d*, 1*e* a first driving wheel 13, mounted for rotary movement, is driven by traction assembly including first traction belt 14 and engaged by a second traction belt 22. The second traction belt 22 drives a second driving wheel 9 rigidly connected with a coupling portion 3 and connected to a shaft 2 which is mounted on the free end of arm 1. Shaft 2 is also mounted by means of ball bearings 7 and 8 which are held in positive and frictional engagement on outriggers 1*a*, 1*b* of arm 1** by means of snap connections.

Coupling portion 3 is provided with grooves **3*a* which are positively engaged by claws 5*e* of a sleeve 5. Sleeve 5 is shiftable on shaft 2 and comprises on its circumferential surface a circumferential cam groove 5*b* with a pitch advancing and returning in the shifting direction. A projection 11, which is stationarily mounted on arm 1, engages cam groove 5*b*. Sleeve 5 has a concentric collar 5*d* and an eccentric collar 5*e*** directly adjacent thereto.

A second wheel 4 is shiftably mounted on the concentric collar **5*d* and has diametrically arranged indentations 4*a* which are engaged by diametrically arranged entrainment members 5*c* which are mounted on sleeve 5. The entrainment members 5*c*, which are provided with rounded crests, engage inclined surfaces 5*b* of the indentations 4*a*, such surfaces being arranged in the path of movement of the entrainment members 5*c*. The outer circumference of the second wheel 4 is provided with a smooth surface (low friction coefficient). A first wheel 6, in the form of a radial ball bearing, is disposed on the eccentric collar 5*a* of sleeve 5. The inner ring of such bearing is firmly seated on collar 5*a* and, at the outer circumference of its outer ring, is provided with a layer having high static friction (high friction coefficient). The wheels 4 and 6** have the same diameter.

A lug **1*c*, associated with a light barrier 10, is molded to arm 1. The front abutment 19 of the collecting tray 20 is mounted for pivotal movement about a journal 19*a*** and movable in the direction of the arrow "D" by an electromagnet (not illustrated).

The sheet-aligning device functions as follows. Under the action of the weight of the components arranged on arm 1, the wheels 4 and 6, respectively, rest on the bottom of the collecting tray 20 and on sheets accumulated on said bottom, respectively. Coupling portion 3, set in rotary motion by the traction means 14 and 22, entrains sleeve 5 and the second wheel 4 positively engaged with that sleeve by rotation in the direction of arrow "E". The rotating sleeve 5 slides with its circumferential cam groove **5*b* along stationary projection 11 and during such movement is moved to and fro once along shaft 2** during each revolution.

During one revolution of sleeve 5, the first and second wheel 6 and 4, respectively, are alternately moved into engagement with the sheet such that, during the first half of the revolution of sleeve 5, only wheel 4 rests on the sheet while the first wheel 6 is separated from such sheet due to its eccentricity. During the second half of the revolution, however, only the first wheel 6 rests on the sheet and, as a result of its eccentricity, separates the second wheel 4 from the sheet.

With respect to the pitch of the circumferential cam groove **5*b*, the eccentric collar 5*a* of sleeve 5 is arranged such that, when sleeve 5 is moved by the pitch of cam groove 5*b* in the direction of the arrow "F", the second wheel 4 rest on the uppermost sheet, and the first wheel 6 is lifted off such sheet. Since the second wheel 4 rests on the uppermost sheet, relative torsion occurs between such wheel and the rotating sleeve 5. As a result, the entrainment members 5*c* move against the inclined surfaces 4*b* of the second wheel 4, urge such wheel into contact with the outer ring of the first wheel 6 and entrain such wheel by frictional engagement while rotating in the direction of the arrow "E". When the first wheel 6 has been set in motion, it comes to rest on a sheet entering the collecting tray 20 in the direction of the arrow "A" during the second half of a revolution of sleeve 5. During such revolution of sleeve 5, a shifting movement occurs in the direction of the arrow "C" and moves such sheet in the direction of the arrow "B" (see FIG. 1), both toward the front abutment 19 and the lateral limiting wall 18. Since the second wheel 4 is separated from the sheet during the engagement of the sheet with the first wheel 6, the relative torsion of the second wheel 4 is no longer effective. Accordingly, the frictional engagement with the first wheel 6 is interrupted. Hence, the first wheel 6 only influences the sheet to be aligned by the entraining momentum of its weight thus released. Thus, when the sheet reaches its end position at the front abutment 19 and the lateral limiting wall 18**, respectively, it is not further advanced unnecessarily and compression is avoided.

When the first wheel 6 has rotated so far that, due to its eccentric mounting, its effective surface retreats behind the outer circumference of the second wheel 4, the device rests with the smooth surface of the second wheel 4 on the uppermost sheet. Sleeve 5 slides back in the direction of the arrow "F" until it reaches the point of reversal of cam groove **5*b*. Subsequently, the sleeve 5 start another shifting movement in the direction of the arrow "C", during which the first wheel 6** is set in motion, and then carries out it transport function as described before. Depending on the distance over which the sheets to be aligned have already automatically passed under the action of gravity when they arrive in the direction of arrow "A", they are more or less frequently subjected to pulse-type transport movement until they have reached their final position. During its pulse-type transport movements, each sheet is only transported by small distances of, for example 4 to 5 mm, so that it is not compressed when reaching its final position.

The first wheel 6 is only brought into engagement with the sheet in the manner described when sleeve 5 is moved by the rising cam section of cam groove **5*b*** in the direction of the arrow "C". In this way, the sheet to be aligned is engaged in a pulse-type manner and transported in the direction of the arrow "B" but is repeatedly released between the transport phases in that the first wheel 6 is lifted so that tension that might lead to compression can be relieved. Moreover, as described before, during the transport phase, the alignment of the sheets only depends on the entraining momentum of the weight of the first wheel 6 released. Since the area of engagement of the first wheel 6 with the sheet is located adjacent to the sheet edges to be aligned, the sheet is very resistant to kinking. All these steps result in the sheets being reliably and rapidly aligned and in tension, built up during alignment and leading to compression, being relieved in the phases in which the first wheel 6 is separated from the sheet so that the sheet can be stacked in a plane position with their edges precisely aligned.

The sheet reliably stacked and aligned in this manner can subsequently be stapled by a stapling device 17 to form an aligned set. When the front abutment 19 is opened in the direction of the arrow "D", the stapled sheet stack 21 can be transferred to a depositing device (not illustrated) connected to the unit.

In order that the accumulated sheet stack 21 should not exceed the stack height that can be handled by the stapling device 17 without disturbances, a device is provided for limiting the height of the sheet stack. Such device comprises a stationary fork-type light barrier 10 which is adapted to receive the lug 1*c* molded to arm 1 of the aligning device. As soon as the stack height that can be maximally handled by the stapling device has been reached, lug 1*c* covers the light barrier 10 which interrupts the further transport of sheets. Since lug 1*c* is an integral part of arm 1, the stack height can be measured in an advantageous manner by the aligning device resting under the action of gravity on the sheet stack 21 while the sheet stack 21 is compressed, and thus under conditions essential for determining whether a sheet stack 21 has been stapled in a functionally proper manner. In contrast to the embodiment described, the stack height can also be measured by means of a switch 23 arranged in the path of movement of arm 1 and indicated in dash-dotted lines in FIG. 2.

Figure 5:
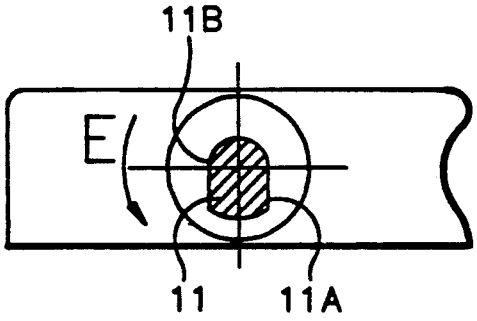
FIG. 5 is a partial sectional view, along line A—A, of the device according to FIG. 4.
Figure 4:
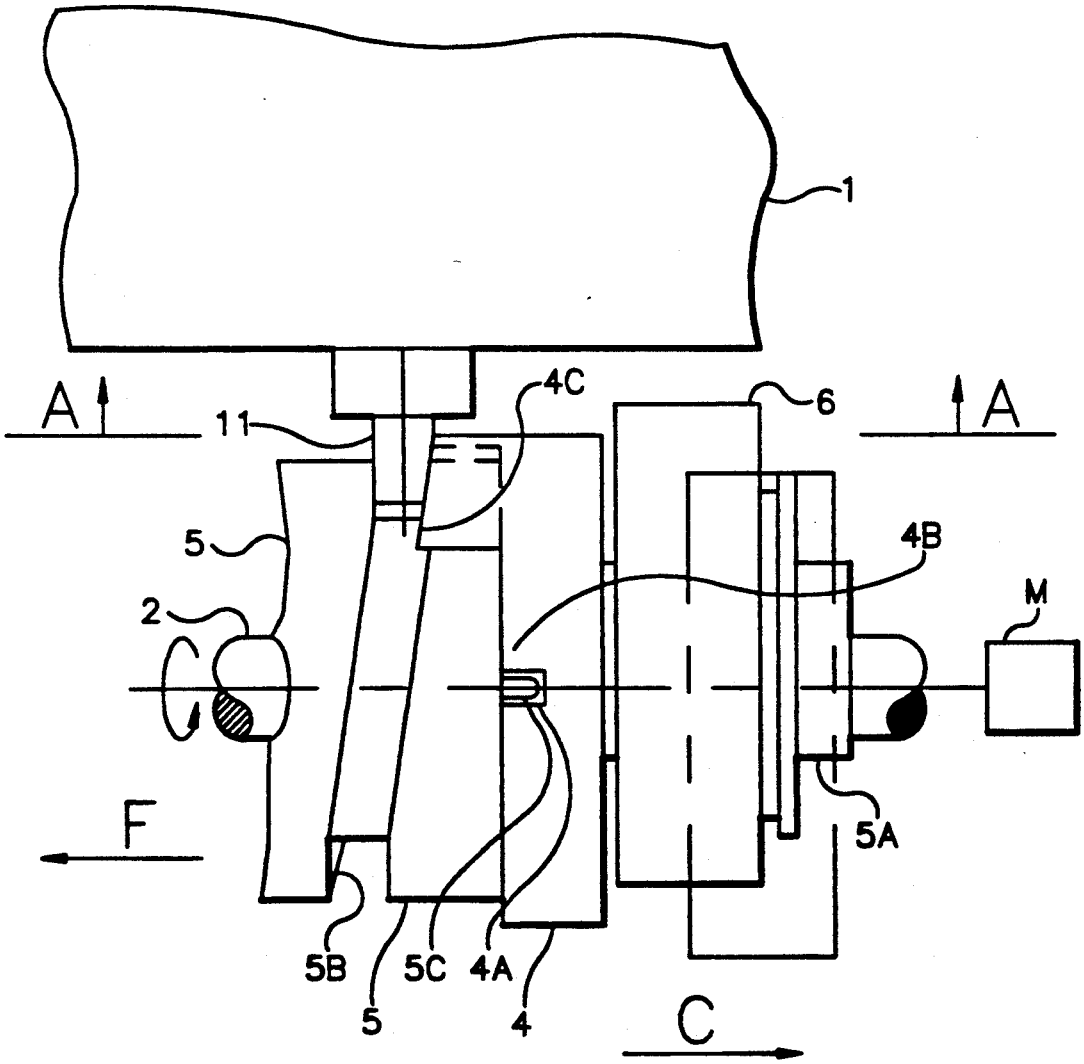
FIG. 4 is a partial enlarged view of an embodiment of the device according to FIG. 1.

A further embodiment of the aligning device according to the invention, to be described with reference to FIGS. 4 and 5, is directed at improving the frictional engagement between the first and second wheel 6 and 4, respectively. The projection 11, according to FIG. 4, is mounted in arm 1 for rotation about it longitudinal axis and is urged by a spring (not illustrated) for rotary movement in the direction of the arrow "E" (see FIG. 5). The portion of projection 11 which engages the cam groove 5*b* is provided with flattened walls 11*a*, 11*b* held in frictional engagement with the walls of cam groove 5*b*. The second wheel 4 of this embodiment is provided with indentations 4*a* (see FIG. 4). The indentations 4*a*, via entrainment members 5*c*, allow a positive engagement with sleeve 5 and a shifting movement in the direction of the arrow "C". The shifting movement is brought about by an inclined surface 4*c* provided on the second wheel 4, such surface extending into the path of movement of projection 11 and engaging, rather than the cam groove 5*b* provided in that area, projection 11 and its face 11*a*, respectively. The inclined surface 4*c*, which forms an arcuate segment enclosing sleeve 5, is adapted to the shape of cam groove 5*b*.

The functioning of the device according to FIGS. 4 and 5 differs from that of the first embodiment as follows. As soon as projection 11 reaches the inclined surface 4*c* while sleeve 5 is rotating, the torque applied to projection 11 by it spring is transmitted to the second wheel 4 and urge such wheel into frictional engagement with the first wheel 6. As a result of this frictional engagement, the first wheel 6 is entrained and set in rotary motion, the frictional engagement terminating when the projection leaves the inclined surface 4*c*. Accordingly, the first wheel 6 is exclusively driven by the motion imparted by the entrainment and thus acts on the sheet to be aligned. Owing to the spring-urged torque of projection 11, its faces 11*a*, 11*b* permanently rest against the walls of cam groove 5*b*. The inclined surface 4*c* is thus reliably urged aside so that the frictional engagement between the second and the first wheel 4 and 6, respectively, occurs under constant conditions.

Figure 2:
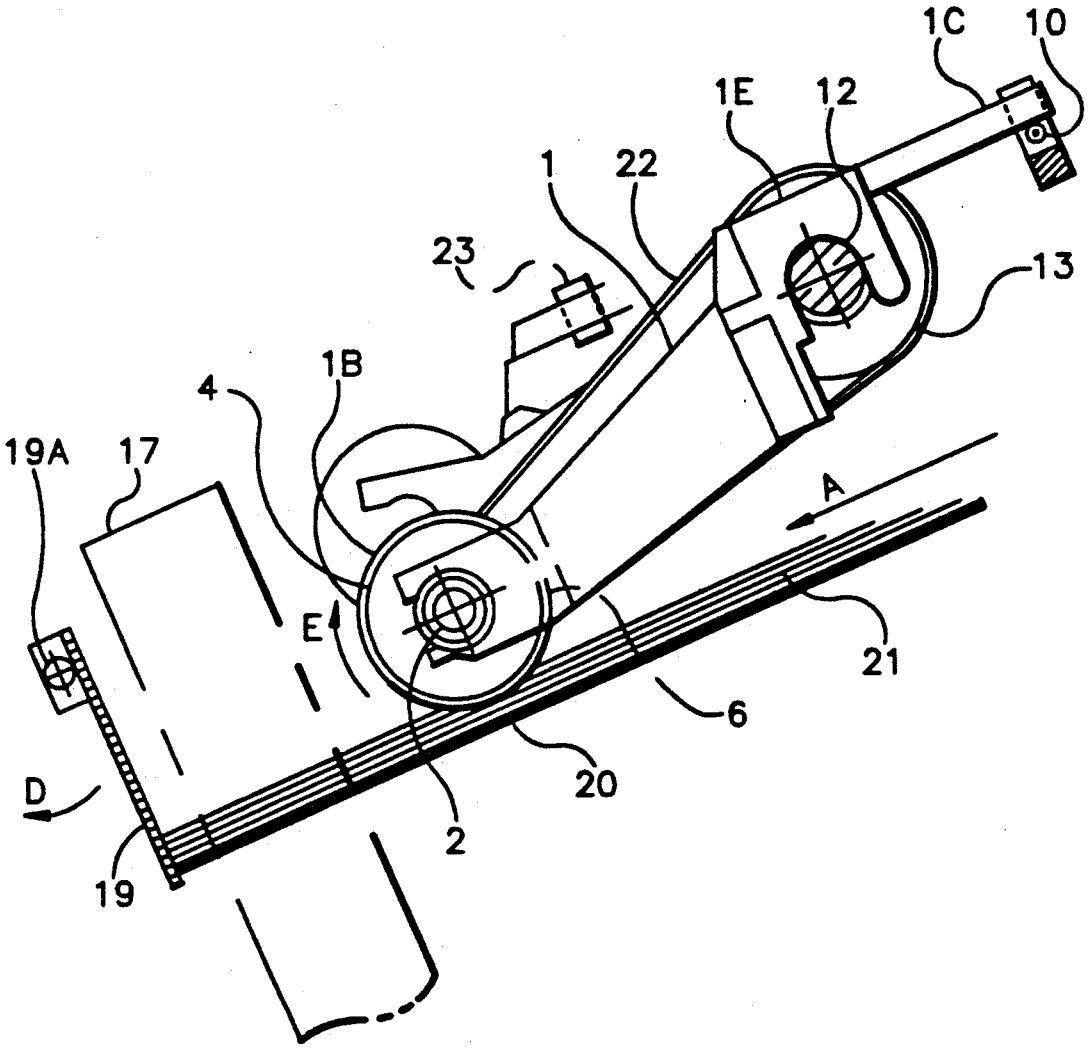
FIG. 2 is a side elevational view of the sheet-aligning device according to FIG. 1.
Figure 3:
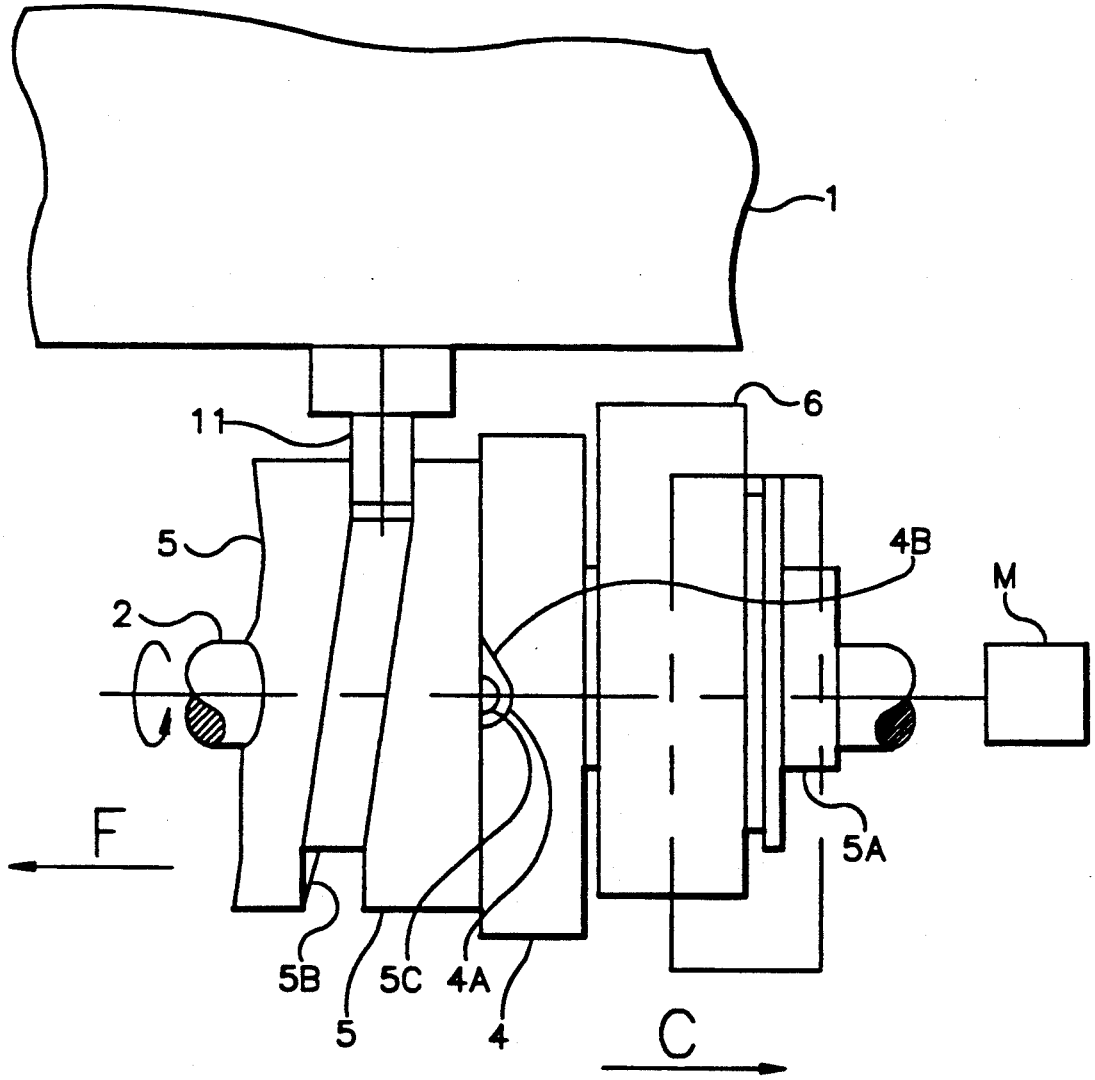
FIG. 3 is a partial enlarged view of the device according to FIG. 1.

In contrast to the embodiment according to FIGS. 1 and 2, the driving motor M is arranged at the free end of arm 1 (not illustrated) and directly drives shaft 2. A drive designed in this manner helps to avoid vibrations or movement caused by the traction means so that smooth operation of the aligning device is achieved.

The above description and the drawings are confined to features which are essential to the invention. Those features which are disclosed in the description and in the drawing but are not mentioned in the claims also serve for defining the subject matter of the invention, if required.

I claim:

1. Device for aligning sheets which are individually supplied to a collecting tray in which they are stacked one above the other, said collecting tray having a support surface and a lateral limiting wall arranged parallely with the direction of entrance of the sheets as well as an abutment associated with the front end side of the sheets, said sheet-aligning device for aligning said sheet both at said lateral limiting wall and at said front abutment comprising:

a pivotable arm (1);

first and second drivable wheels (4, 6) of identical diameter arranged on a common shaft (2) at the free end of said pivotable arm (1), said first wheel (6) mounted for rotation on a first collar (5*a*) of a rotatably mounted sleeve (5), said collar being disposed eccentrially with respect to said common shaft (2), and said second wheel (4) arranged on a second collar (5*d*) of said rotary sleeve (5), said second collar being disposed concentrically with respect to said common shaft (2);

said sleeve (5) together with the first and second wheel (6 and 4, respectively) being shiftable on said common shaft (2);

said second wheel held in positive engagement with said sleeve (5), and said sleeve (5) permanently held in positive engagement with a rotatably mounted and drivable coupling portion (3); and said first wheel (6), when resting on the incoming sheet, being shiftable toward the lateral limiting wall (18) and, when separated from said sheet, shiftable in the opposite direction.

2. Device for aligning sheets according to claim 1 further comprising means (10 or 23) arranged in the path of pivotal movement of said pivotable arm (1) for interrupting further transport of sheet toward said collecting tray (20) when a predetermined height of the sheet stack on said tray has been reached.

3. Device for aligning sheets according to claim 1 wherein said sleeve (5) comprises a circumferential cam groove (5*b*) arranged on its circumferential surface and having an advancing and returning pitch in the direction of shifting, and a projection (11) stationarily arranged on said pivotable arm (1) engaging said cam groove (5*b*).

4. Device for aligning sheets according to claim 3 wherein said first and second wheel (6 and 4, respectively) are arranged directly adjacent to each other, said first wheel (6) being mounted closest to the lateral limiting wall (18), said second wheel (4) being arranged between said first wheel (6) and a shoulder portion of said second collar (5*d*) of said sleeve (5), said second wheel (4) defining on its side facing away from the first wheel (6) an inclined surface (4*b*) which is periodically brought into engagement with an entrainment member (5*c*) of said sleeve (5), said second wheel (4) axially shiftable and urged into contact with said first wheel (6) by frictional engagement when engaged with said entrainment member to shift said second wheel, and said first wheel (6) entrained by frictional engagement when said second wheel is in its shifted position.

5. Device for aligning sheets according to claim 4 wherein said circumferential surface of said first wheel (6) has a high coefficient of friction and the circumferential surface of said second wheel (4) has a low coefficient of friction.

6. Device for aligning sheets according to claim 4 wherein said first wheel (6) is a radial ball bearing whose inner ring is frictionally connected with said eccentrical collar (5*a*) of said sleeve (5) and whose outer ring is drivable by frictional engagement and is provided with a layer of high static friction.

7. Device for aligning sheets according to claim 1 wherein said arm (1) includes outriggers (1*a*, 1*b*) in a fork-shaped arrangement at its free end for rotatably mounting said shaft (2), said drivable coupling portion (3), said first and second drivable wheels (4,6), said sleeve (5), and said projection (11) arranged between said outriggers (1*a*, 1*b*).

8. Device for aligning sheets according to claim 1 wherein said coupling portion (3) is driven by a traction assembly (9, 13, 14, 22) whose power take-off occurs at a shaft (12) serving as a journal (12) for said arm (1).

9. Device for aligning sheet according to claim 1 wherein said coupling portion (3) is drivably connected to a motor engaging said shaft (2).

10. Device for aligning sheets according to claim 3 wherein said first and second wheel (6 and 4, respectively) are arranged directly adjacent to each other, said first wheel (6) being mounted closest to the lateral limiting wall (18), said second wheel (4) being arranged between said first wheel (6) and a shoulder portion of said second collar (5*d*) of said sleeve (5), said second wheel (4) defining on its side facing away from the first wheel (6) an inclined surface (4*c*) which is periodically brought into engagement with said stationary projection (11), said second wheel (4) axially shiftable and urged into contact with said first wheel (6) by frictional engagement when engaged with said projection to shift said second wheel, and said first wheel (6) entrained by frictional engagement when said second wheel is in its shifted position.

* * * * *